US005890633A

United States Patent [19]

Skillin et al.

[11] Patent Number: 5,890,633

[45] Date of Patent: Apr. 6, 1999

[54] TWO COMPONENT, MOLDED PLASTIC DISPENSER OPERATING ON PUSH-PULL PRINCIPLE

[75] Inventors: Clifford W. Skillin, Blackstone, Mass.; Joseph E. Johnson, Noank, Conn.

[73] Assignee: Polytop Corporation, Slatersville, R.I.

[21] Appl. No.: 862,253

[22] Filed: May 23, 1997

[51] Int. Cl.[6] ..... B67D 3/00

[52] U.S. Cl. ..... 222/523; 222/525

[58] Field of Search ..... 222/522, 523, 222/524, 525

[56] References Cited

U.S. PATENT DOCUMENTS

| | | | |
|---|---|---|---|
| 594,258 | 11/1897 | Lines | 222/524 |
| 2,037,922 | 4/1936 | Punte | 222/525 |
| 2,484,148 | 10/1949 | Beatty et al. | 65/57 |
| 2,597,165 | 5/1952 | Minturn | 222/513 |
| 3,032,240 | 5/1962 | Dunklee | 222/525 |
| 3,511,420 | 5/1970 | Kessler | 222/525 |
| 3,844,455 | 10/1974 | Stull | 222/525 |
| 4,506,809 | 3/1985 | Corsette | 222/213 |
| 4,690,304 | 9/1987 | Morel | 222/44 |
| 4,749,103 | 6/1988 | Barriac | 222/48 |
| 4,767,034 | 8/1988 | Cramer | 222/525 |
| 4,979,648 | 12/1990 | Montgomery et al. | 222/522 |
| 5,431,305 | 7/1995 | Kaminski | 222/109 |
| 5,472,120 | 12/1995 | Stebick et al. | 222/153.06 |
| 5,507,416 | 4/1996 | Rapchak et al. | 222/153.07 |
| 5,655,685 | 8/1997 | Carr et al. | 222/525 |

*Primary Examiner*—Joseph A. Kaufman
*Attorney, Agent, or Firm*—Hoffman, Wasson & Gitler

[57] ABSTRACT

A two piece, molded plastic dispenser, that functions with a push-pull motion, comprising an outer shell and an inner shell. The outer shell comprises a top wall with an aperture defined at its center, and a skirt of generally cylindrical shape. A plug seal extends below the top wall, and annular groove and bead are formed in the vicinity of the upper end of the inner surface of the skirt and the underside of the top wall. The inner shell comprises a top wall, a tapered spud extending upwardly from the top wall, an annular barrier encircling the spud, and a depending skirt. Detents and arcuate wall segments extend, in interspersed fashion, about the perimeter of the upper shell, and cooperate with the bead on the outer shell. Vertical ribs on the inner surface of the outer shell cooperate with serrations on the exterior surface of the inner shell to guide the relative movement of the outer shell, in a vertical direction, while preventing relative rotation between the shells. The contents of the container are discharged through apertures in the inner shell proximate to the spud to flow through the aperture in the outer shell. The plug seal and annular barrier, and the spud and aperture, are fully engaged, when the dispenser is closed, to provide leak-proof operation. The arcuate walls segments extend vertically above the detents to protect same, and the underside of the annular bead abuts a shoulder on each wall segment when the dispenser is closed.

15 Claims, 4 Drawing Sheets

TWO COMPONENT, MOLDED PLASTIC DISPENSER OPERATING ON PUSH-PULL PRINCIPLE

FIELD OF THE INVENTION

The present invention pertains generally to molded plastic dispensers that are secured to containers for hair care and/or health care products, or the like, so that the contents of the container can be discharged, in measured quantities. More particularly, the invention relates to dispensers consisting of two molded plastic components, that are interlocked to prevent relative rotation, while permitting vertical movement therebetween, in response to manual pressure.

BACKGROUND OF THE INVENTION

Manually operable, molded plastic dispensers, that are secured to containers for diverse products, such as hair care products, beauty aids, skin creams lotions, health care products, etc. are well known and have gained widespread acceptance. Such dispensers must be inexpensive to manufacture, and assemble, lend themselves to installation on containers by automated machinery operating at high throughput, and function satisfactorily over the life span of the product being dispensed. Also, such dispensers must be aesthetically pleasing, capable of being sealed to avoid leakage during shipment, and capable of being manipulated between an opened, and a closed, condition, without the accumulation of unsightly excess product on exposed surfaces. A representative dispenser that addresses some, if not all, of the concerns noted above, is disclosed in U.S. Pat. No. 5,472,120 granted Dec. 5, 1995 to Stebick et al.

Stebick et al discloses a cap 10 for a container having three distinct positions, namely, a closed position shown in FIG. 1A, an intermediate spray position shown in FIG. 1B, and a fully open, pour position shown in FIG. 1C. The cap provides a fluid tight seal when in the closed position, as indicated by sealing areas A, B, C, and D, shown in FIGS. 1A and 4. The cap provides a fluid tight seal from pouring, when in the spray position, for plug 38 on stem 32 of chimney 24, fits snugly within central pouring aperture 54.

Cap 10 in Stebick et al includes a shell 12 defining a fluid passage 42 to the container, and a tip 14 with pouring aperture 54 and spray 56 apertures axially movable relative to the shell. The extent of the axial movement is governed by the engagement of annular rings 64 on the inner surface of sidewall 52 of tip 14, as shown in FIG. 3C, with the axially spaced grooves or indents 28 in the outer wall of chimney 24, as shown in FIG. 2A. Tip 14 is pulled up to select a dispensing position, which causes plug 38 to engage, or disengage, with aperture 54, depending on the selected dispensing option.

SUMMARY OF THE INVENTION

Whereas the dispenser shown in Stebick et al, and other push-pull dispensers, shown as those shown in U.S. Pat. No. 4,749,103, granted to Barriac, function satisfactorily, applicants have designed a functionally superior dispenser, operating on the push-pull principle. More particularly, applicants' dispenser comprises a push-pull dispenser consisting of two molded plastic components, namely, an outer shell, and an inner shell, with interlocking members, such as serrations and ribs, defined therebetween, so that said shells are aligned and locked together as a unitary dispenser that is secured to the open, upper end of a container for hair shampoo, cleansers, food products, and the like.

The outer shell is movable vertically, relative to the inner shell, between two positions, (1) a normally closed position and, (2) a fully opened position for dispensing the contents of the container. In the closed position, a centrally located, upwardly projecting spud, fits within a central aperture in the upper wall of the outer shell. In the opened position, the spud is withdrawn from the central aperture, and product flows through an annular channel defined in the inner shell, through spaced flow passages into the outer shell, and thence exits through the central aperture. The entire outer shell is grasped by the user, thus facilitating opening and closing ease.

Small manual forces applied to the dispenser are translated completely into opening, and closing, movements for the dispenser. The instant dispenser is thereby readily operated by persons of all ages, including young children, and older adults with limited manual dexterity.

The outer shell comprises a unitary molding comprising a top wall, a depending skirt, and a centrally located aperture in the top wall. A plug seal depends from the underside of the top wall.

The inner shell is slightly smaller than the outer shell and comprises a top wall and a depending skirt. A tapered spud extends upwardly from the top wall, and an annular barrier surrounds the base of the spud. The plug seal coacts with the annular barrier to create a seal, which is effective over the range of vertical travel of the shells. The resulting dispenser is thereby effectively sealed in a leak-proof manner.

An annular groove is formed in the inner surface of the depending skirt of the outer shell. The groove is located just below the intersection of the upper surface of the outer shell and the skirt, while stops are situated below the ribs but above the lower end of the skirt of the outer shell. An inwardly extending annular bead is located adjacent to the groove in the outer shell. Three flexible detents are located about the upper perimeter of the inner shell. The snap action of the detents engaging the annular bead produces an audible click to indicate that the dispenser is fully closed. Similarly, contact with the stops indicates that the dispenser is completely opened. The audible clicks are reassuring to the user at all times, and are particularly important when one is using the dispenser to discharge a shampoo, or cleansing product, in the shower.

The detents are separated from each other at 120° intervals, by arcuate wall segments. The segments are rigid and unyielding, while the detents exhibit some degree of resiliency. The annular, inwardly projecting bead is located adjacent to the groove, but spaced vertically below the groove. A shoulder is defined on the outer surface of each arcuate wall segment. When the shells are interlocked, and the outer shell is moved vertically to the closed position, the bead contacts, and rests upon, the shoulders, while the detents engage the annular bead.

The closed position of the dispenser is positively defined. Consequently, the dispenser is leak-proof, and if the dispenser is subjected to an impact force, such as may occur during shipping, or when the container is dropped, the surface-to-surface contact dissipates these forces and resists damage to the container and dispenser.

The arcuate wall segments are greater in height than the detents, so that the arcuate wall segments shield, and protect, the detents from damage. Also, the detents are situated on the upper side of the top wall of the inner shell, and are isolated from contact with the product being dispensed by an annular barrier disposed around the spud. Excess product, or flow-back from the previous dispensing operation, does not reach the detents, contaminate same, or otherwise negatively impact upon their repeated operation.

An annular relief groove is defined around the aperture in the outer shell to enhance the sealing action of the spud within the central dispensing aperture. Consequently, the instant dispenser is leak-proof when the outer shell is moved vertically into its closed position.

The two molded shells are robust in construction, and are molded in high modulus polypropylene or similar material. Such plastic can be produced in a wide variety of eye catching colors, is aesthetically pleasing to the consumer, and can be recycled as a closure assembly. Furthermore, the strength of the molded plastic dispenser enables same to be compatible with high speed assembly equipment, capable of applying 250–500 dispensers, per minute, or more, to containers moving quickly along a packaging line.

Other operational advantages attributable to the instant, simple, readily molded and assembled, inexpensive, two component, push-pull dispenser, will be readily apparent, to the skilled artisan, when the appended drawings and ensuing specification are construed in harmony.

BRIEF DESCRIPTION OF THE PREFERRED EMBODIMENT

Figure 1:
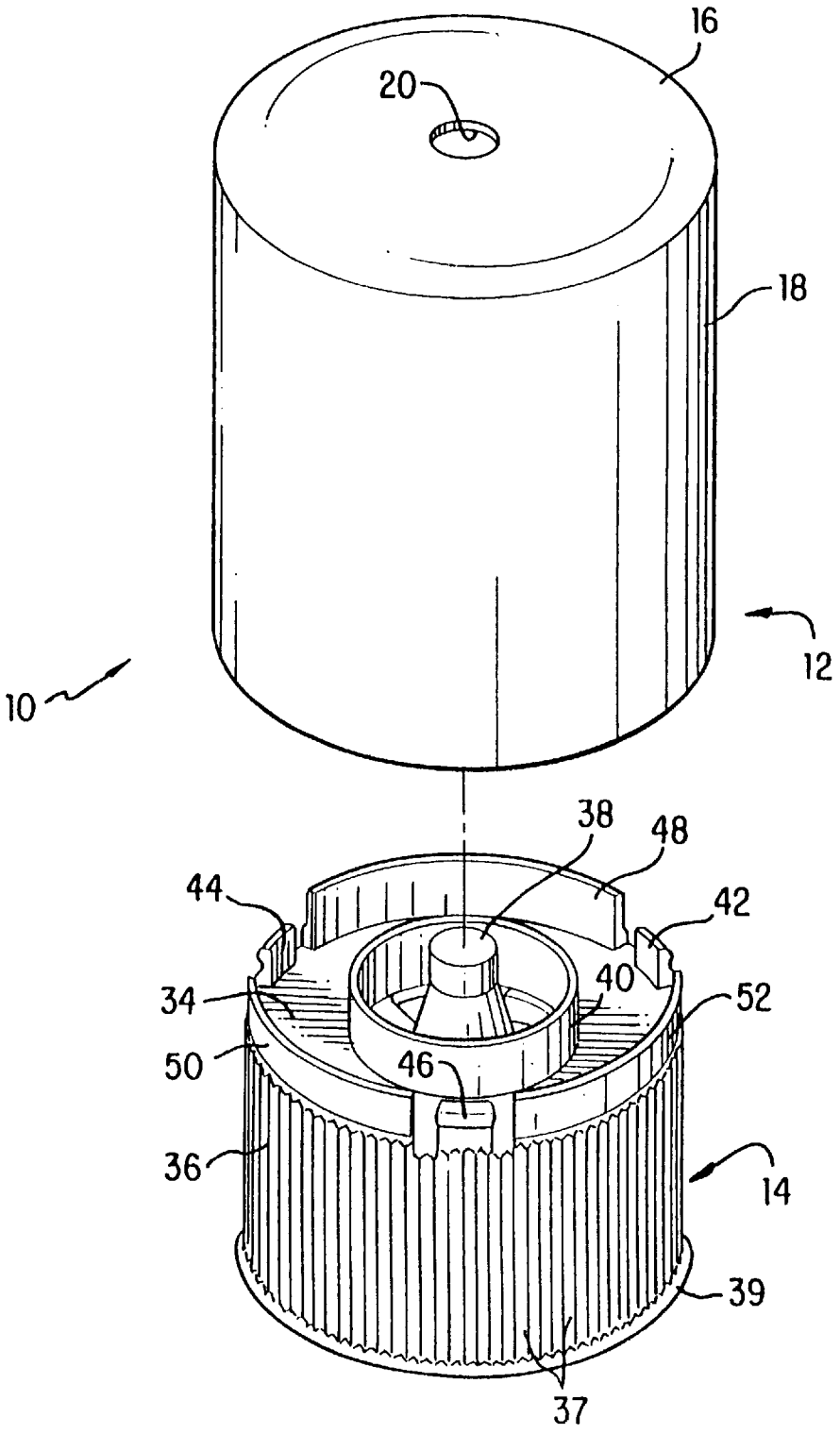
FIG. 1 is an exploded perspective view of a two component molded plastic, push-pull dispenser constructed in accordance with the principles of the instant invention.

FIG. 1 depicts a two component, molded plastic, dispenser 10 embodying the principles of the instant invention, such dispenser operating on the push-pull principle. Dispenser 10 consists of two components, namely, outer shell 12 and inner shell 14. Outer shell 12 is a unitary, generally cylindrical, molded plastic member comprising a top wall 16 and a depending skirt 18. Top wall 16 is interrupted by a centrally located aperture 20.

Figure 2:
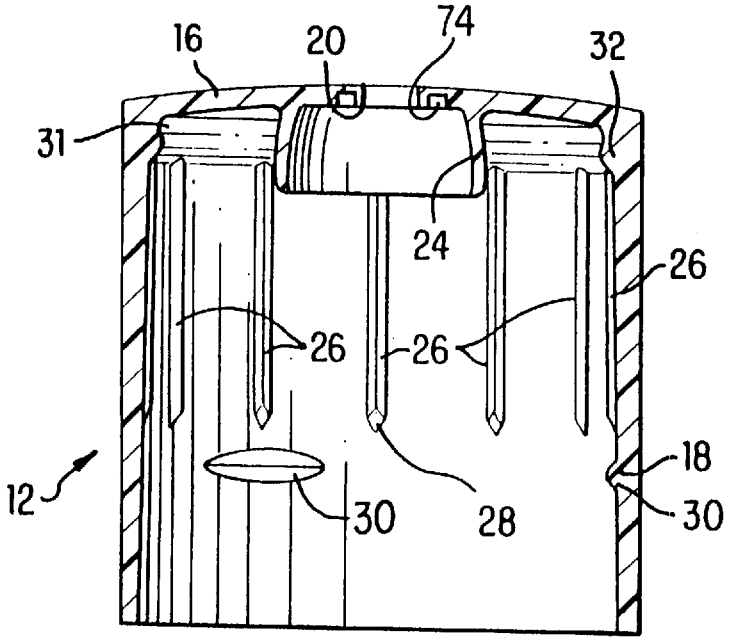
FIG. 2 is a vertical, cross-sectional view of the outer shell of the dispenser.

As shown in FIG. 2, plug seal 24 extends downwardly from the inner surface of top wall 16. Several vertically extending parallel ribs 26 are spaced about the inner surface of shell 12, and chamfers 28 are formed at the lower ends of the ribs. Stops 30 are equally spaced about shell 12. An annular groove 31 is formed above the upper end of ribs 26 and below the inner surface of top wall 16; an annular bead 32 is defined below groove 31 and adjacent thereto.

Figure 3:
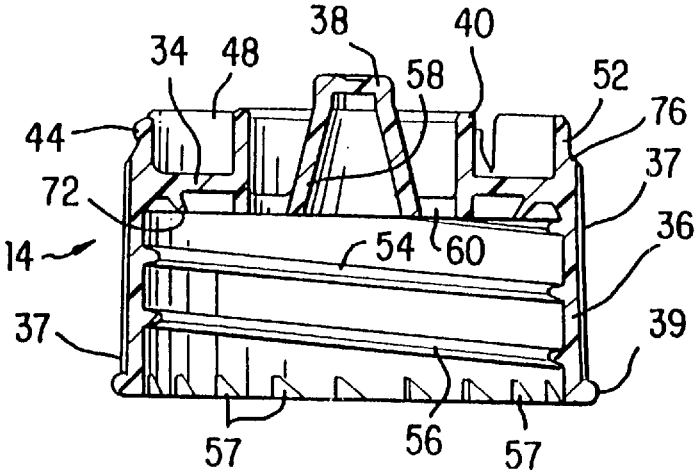
FIG. 3 is a vertical, cross-sectional view of the inner shell of the dispenser.

FIGS. 1 and 3 show inner shell 14, which is a unitary, generally cylindrical molded plastic member comprising a top wall 34 and a depending skirt 36. Shell 12 is slightly larger in diameter than shell 14, so that shell 12 can be slipped over shell 14, without binding.

Serrations 37 extend vertically around the perimeter of skirt 36, and an annular band 39 encircles the lower end of shell 14. A hollow, tapered spud 38 is centrally located and extends upwardly above top wall 34, while an annular barrier 40 encircles spud 38. Equally spaced detents 42, 44, 46 are spaced about the perimeter of the top wall 34, and arcuate wall segments 48, 50, 52 extend about the perimeter of the top wall. The wall segments are greater in height than the detents, and protect the detents from shock loading, as suggested in FIGS. 3, 5 and 6.

Threads 54, 56 extend, in helical fashion, around the interior surface of skirt 36 of inner shell 14, for securement to the neck of a container (not shown), such as a plastic bottle.

Figure 4:
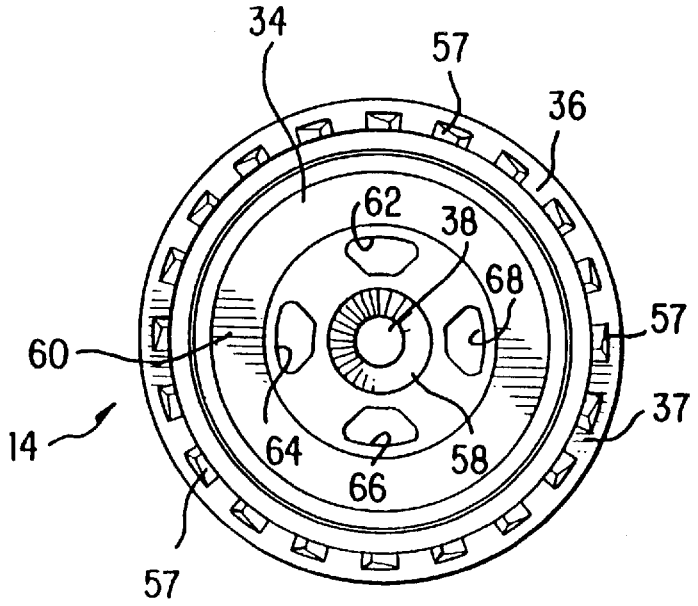
FIG. 4 is a bottom, plan view of the inner shell of FIG. 3.

The entrance 58 into spud 38 is tapered, as shown in FIG. 4, and spud 38 is separated from top wall 34 by bridge 60. Flow passages 62, 64, 66, 68 interrupt bridge 60 at approximately 90° intervals. Sealing lip 72 extends from top wall 34 and presses against the neck of the bottle to achieve a seal. Unlocking dogs 57 are located at the lower end of the interior of shell 14.

Figure 5:
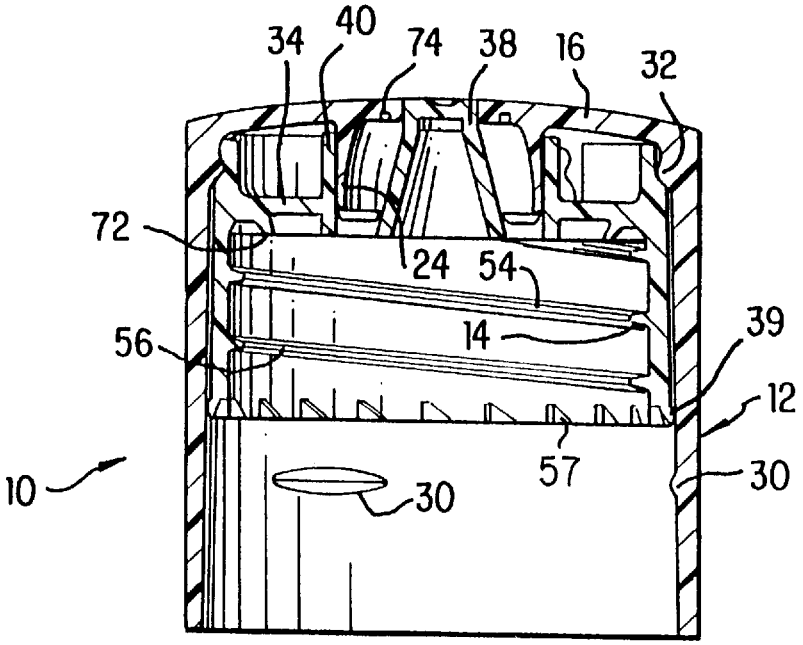
FIG. 5 is a vertical, cross-sectional view of the assembled dispenser in the closed, sealed position.

FIG. 5 shows the inner and outer shells 12, 14 of push-pull dispenser 10 assembled together so that only axial or vertical movement therebetween can be achieved. The assembled dispenser is retained in its closed condition. Inner shell 14 has been screwed into engagement with the neck of the container for the product to be dispensed (not shown). Outer shell 12, which is slightly larger in size, has been slipped over inner shell 14; ramps 28 assist ribs 26 in sliding over serrations 37 on the exterior of skirt 36 of inner shell 14. The shells are mechanically secured together, and need not be rotated to any particular point of alignment, before joinder occurs. The inner surface of outer shell 14 is slightly tapered to facilitate joinder, and subsequent movement of the outer shell relative to the inner shell, without binding.

Detents 42, 44, 46, which may assume the form of flexible fingers with projecting surfaces, snap into engagement with groove 31 on outer shell 12 to define the closed position for the dispenser. Plug seal 24 on outer shell 12 presses against annular barrier 40 on inner shell 14, in a sealing relationship, while the upper end of spud 38 fits snugly within central aperture 20. Lip 72 seals tightly against the container to which dispenser 10 is secured. Shells 12, 14 are retained in a leak-proof relationship. A shoulder 76 is formed on the exterior of each wall segment; bead 32 on shell 12 is seated upon shoulder(s) 76 when outer shell 12 is shifted to its closed position. The bead and shoulder(s) cooperate to isolate resilient detents 42, 44, 46 from shock loading, as may occur when the dispenser is dropped during use, or during shipment, when boxes of filled dispensers are stacked upon each other.

Figure 6:
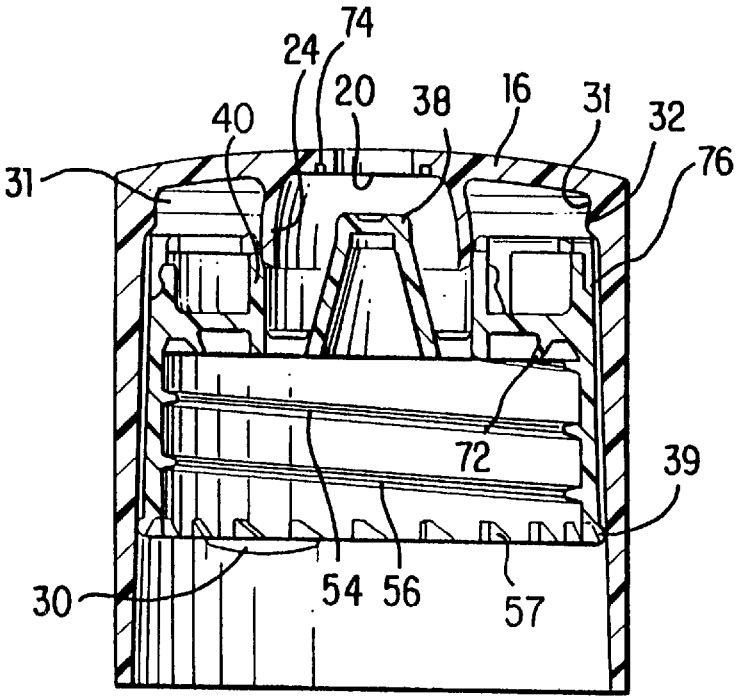
FIG. 6 is a vertical cross-sectional view of the assembled dispenser, in its opened, dispensing position.

FIG. 6 shows push-pull dispenser 10 in its opened, or dispensing, position. By grasping outer shell 12 and applying manual pressure of sufficient magnitude to disengage detents 42, 44, 46 from groove 31, outer shell 12 is shifted axially relative to inner shell 14 until stop 30 contact the lower band 39 on the skirt of the skirt of the shell 14. Plug seal 24 contacts barrier 40, but does not overlap same. Flow passages 62, 64, 66, 68 in bridge 60 are in communication with the interior of the container, and the contents of the container flow through the passage and along the perimeter of spud 38. The product then flows beyond the spud and exits dispenser 10 through central, or discharge, aperture 20 in outer shell 12. When the desired amount of product has been discharged, the user grasps outer shell 12 and shifts same downwardly until spud 38 fits snugly into aperture 20 and seals same completely. The other sealing members, plug seal 24 and barrier 40, contribute to the leak-free sealing of the dispenser.

An annular relief groove 74 is defined in the underside of top wall 16 of outer shell 12; the annular relief groove 74 makes the area surrounding aperture 20 more flexible, and facilitates the sealing action of spud 38 within dispensing aperture 20.

Detents 42, 44, and 46 are flexible enough to produce an audible "click" when engaging bead 32 to define the closed position for dispenser 10. Stops 30 are so configured that a click, or other audible indication, is present, when the dispenser reaches its open position. The "click," or other audible clues, may be used with tactile signals, as well, so that the user can readily discern the two operating conditions for the push-pull dispenser. The push-pull dispenser may find particular application for hair treatments, such as shampoos, wherein the dispenser is frequently inverted when taking a shower or bath.

Numerous modifications will occur to the skilled artisan from a review of the foregoing description and an inspection of the illustrative drawings. For example, ribs might be formed on the exterior of the inner shell and serrations might be formed on the interior surface of the skirt of the outer shell. A second annular groove and detent arrangement might be used in lieu of the stops defined on the interior of the skirt of the outer shell. The interior of the outer shell may have a stepped configuration to facilitate joinder of the two shells, without binding. The shells need not be cylindrical shape, but may assume some other polygonal form. Beads either continuous or interrupted, may be formed on the interior surface of the inner shell, for interaction with a complementary bead on the neck of the container; the interactive beads may be used in lieu of a threaded interconnection. Consequently, the claims should be construed in a liberal manner consistent with the spirit of the invention, and should not be limited to their exact, literal terms.

We claim:

1. A molded plastic dispenser adapted to be secured to a container for discharging the contents thereof, said dispenser comprising:

a) an outer shell comprising a top wall, a discharge aperture in said top wall, and a depending cylindrical skirt, b) an inner shell configured to fit snugly within said outer shell, c) said inner shell comprising a top wall and a depending skirt, d) a spud extending upwardly from said top wall of said inner shell, e) flow passages formed through said top wall of said inner shell adjacent said spud, f) cooperating mechanical members defined between the interior surface of said skirt of said outer shell and the exterior surface of said skirt of said inner shell to prevent relative rotation therebetween, g) relative movement between said shells alternately seating said spud within said aperture to prevent discharge, and withdrawing said spud from said aperture to allow flow of product through said flow passages, along said spud, and through said discharge opening, h) stops distributed about the interior of the depending skirt of said outer shell to limit the relative movement of said inner shell and prevent disassembly of said shells, i) an annular, inwardly extending bead is located on the inner surface of said outer shell, j) and a plurality of detents extend upwardly from said top wall of said inner shell, said detents snapping into engagement with said bead on said outer shell to retain said shells in closed, non-dispensing position.

2. A dispenser as defined in claim 1 wherein said plurality of detents are three in number, and said detents are spaced at 120° intervals.

3. A dispenser as defined in claim 1 wherein arcuate segmental walls are interspersed with said detents, said segmental walls extending vertically a short distance above said detents, said segmental walls being rigid and non-yielding to protect said detents from vertically directed impact and loading forces.

4. A dispenser as defined in claim 3 wherein three identical arcuate segmental walls extend above the upper wall of said inner shell.

5. A dispenser as defined in claim 3 wherein a shoulder is defined on the outer surface of each segmental wall, and said annular bead on said outer shell abuts against said shoulder when the dispenser is in the closed position.

6. A dispenser as defined in claim 1 wherein said detents are cantilevered fingers.

7. A dispenser as defined in claim 6 wherein each of said cantilevered fingers terminates in an enlarged head, at its upper end, which snaps into locking engagement with said bead.

8. A dispenser as defined in claim 1 wherein said spud is hollow, and tapers from a wide base to a narrower top.

9. A dispenser as defined in claim 8 wherein an annular relief groove is formed in the underside of the top wall of said outer skirt in the vicinity of said aperture, said groove imparting flexibility to the area surrounding said aperture so said spud can easily by seated within, and withdrawn from, said aperture.

10. A dispenser as defined in claim 1 wherein a plug seal depends below the top wall of said outer shell, and an annular barrier encircles said spud, said plug seal contacting said annular barrier when said shells are joined together.

11. A dispenser as defined in claim 10 wherein said plug seal has a bulbous shape for increased sealing action.

12. A dispenser as defined in claim 1 wherein said stops are formed as a discontinuous bead on the inner surface of said outer shell.

13. A dispenser as defined in claim 1 wherein an annular groove is defined in the inner surface of said outer shell below the intersection of said top wall and said depending skirt, and adjacent to said annular bead.

14. A molded plastic dispenser adopted to be secured to a container for discharging the contents thereof, said dispenser comprising:

a) an outer shell comprising a top wall and a depending cylindrical skirt, b) a discharge aperture located in said top wall of said outer skirt, c) an inner shell configured to fit snugly within said outer shell, d) said inner shell comprising a top wall and a depending skirt, e) a spud extending upwardly from said top wall of said inner shell, f) flow passages formed through said top wall of said inner shell adjacent said spud, g) cooperating mechanical members defined between said inner shell and said outer shell to permit movement therebetween, h) stops distributed about the interior of the depending skirt of said outer shell to limit the movement of said inner shell and prevent disassembly of said shells, the invention being characterized by:

i) an annular barrier extending upwardly from the top wall of said inner shell, j) said annular barrier circumscribing said spud and said flow passages, k) a plug seal depending below the top wall of said outer skirt, l) said plug seal circumscribing said discharge aperture, said plug seal contacting said annular barrier at all times to prevent leakage past the seal created by the central aperture being forced over said spud.

15. A dispenser as claimed in claim 14 wherein said spud tapers inwardly as it extends above said top wall of said inner shell, and said plug seal is bulbous in shape to maximize the area of contact with said annular barrier.

* * * * *